United States Patent [19]

Nelson

[11] Patent Number: 4,789,819

[45] Date of Patent: Dec. 6, 1988

[54] BREAKPOINT COMPENSATION AND THERMAL LIMIT CIRCUIT

[75] Inventor: Carl T. Nelson, San Jose, Calif.

[73] Assignee: Linear Technology Corporation, Milpitas, Calif.

[21] Appl. No.: 932,159

[22] Filed: Nov. 18, 1986

[51] Int. Cl.[4] ..... G05F 3/20

[52] U.S. Cl. ..... 323/314; 323/907; 307/310

[58] Field of Search ..... 323/313, 314, 907; 307/310

[56] References Cited

U.S. PATENT DOCUMENTS

| | | | |
|---|---|---|---|
| 4,325,018 | 4/1982 | Schade, Jr. | 307/310 X |
| 4,553,048 | 11/1985 | Bynum et al. | 307/310 X |
| 4,633,165 | 12/1986 | Pietkiewicz et al. | 323/314 |

OTHER PUBLICATIONS

"Linear Databook 1986", Linear Technology Corporation, pp. 3:13–3:24.

"Linear Integrated Circuits", National Semiconductor Corporation, Jan. 1974, pp. 1:18–1:20.

"Linear Databook", National Semiconductor Corporation, 1982 pp. 1:31–1:38.

Alan B. Grebene, "Bipolar And MOS Analog Integrated Circuit Design" John Wiley & Sons, 1984, pp. 170–187, 204–209, 261 and 495–509.

REF-01 Integrated Circuit, Precision Monolithics, Inc., schematic diagram.

Documents and facts relating to the LT 1070 Integrated Circuit, Linear Technology Corporation.

*Primary Examiner*—Patrick R. Salce

*Assistant Examiner*—Kristine Peckman

*Attorney, Agent, or Firm*—Laurence S. Rogers

[57] ABSTRACT

A voltage reference circuit including a Brokaw Cell band-gap reference circuit is provided with breakpoint compensation to adjust the temperature coefficient of the reference voltage provided by the Brokaw Cell as a function of temperature. The voltage reference circuit also includes a thermal limit transistor which is biased by a voltage having a positive temperature coefficient. The thermal limit transistor draws a rapidly increasing current when the operating temperature reaches a predetermined value.

22 Claims, 3 Drawing Sheets

BREAKPOINT COMPENSATION AND THERMAL LIMIT CIRCUIT

BACKGROUND OF THE INVENTION

This invention relates to a circuit for reducing the magnitude of temperature-dependent variation in the voltage output of a band-gap voltage reference circuit.

The operating parameters of monolithic integrated circuits typically exhibit a temperature dependence. Among the sources of such temperature dependence are the base-emitter voltage drop ($V_{BE}$) of a transistor, which has a negative temperature coefficient typically on the order of $-2$ mV/°C., and the difference in the base-emitter voltage drops ($\Delta V_{BE}$) of two mismatched transistors which, through the thermal voltage ($V_T$), exhibits a positive temperature coefficient proportional to absolute temperature.

In the design of an analog integrated circuit such as a voltage regulator, it is necessary to establish a voltage or current reference within the circuit which is substantially independent of variations in temperature. A band-gap voltage reference circuit often is utilized to provide such a reference voltage or current. Such a circuit produces a relatively stable output voltage by compensating the negative temperature coefficient of a base-emitter voltage drop $V_{BE}$ with the positive temperature coefficient of a voltage difference $\Delta V_{BE}$. More particularly, the two temperature coefficients are generated in the circuit and the positive temperature coefficient of voltage difference $\Delta V_{BE}$ due to thermal voltage $V_T$ is scaled with a temperature-independent scale factor (K) and combined with the negative temperature coefficient of base-emitter voltage drop $V_{BE}$ to obtain an output voltage with nominally zero temperature dependence.

In practice, however, the voltage output of a band-gap voltage reference circuit retains a degree of temperature dependence because the temperature coefficients of opposite polarity are both non-linear, such that the respective rates of drift vary with temperature. As a consequence, the two coefficients do not remain in a fixed proportional relationship as the temperature changes, and a nonlinear net temperature coefficient results. Further, the devices which make up the circuit typically exhibit other non-linear temperature coefficients which are not individually compensated. The sum of the uncompensated temperature coefficients produces a net non-linear variation in output voltage as the temperature changes.

For example, in one type of band-gap voltage reference circuit, known as a Brokaw Cell band-gap reference, the output voltage exhibits a temperature dependency which causes the output voltage to gradually fall off at lower and higher temperatures, giving an output voltage curve having the approximate shape of an inverted parabola when plotted against temperature. This degradation of output voltage at lower and higher temperatures limits the minimum temperature coefficient which can be obtained as temperature range increases.

Many circuits which utilize band-gap references also need over-temperature protection. Such protection is necessary to prevent a high-power circuit such as a voltage regulator from sustaining permanent damage due to excessive temperature rise caused by high power dissipation. A thermal shutdown circuit provides the necessary protection by sensing the circuit temperature and automatically shutting down the circuit when the temperature exceeds a predetermined threshold level.

Because a regulator may operate at temperatures close to the desired shutdown temperature, the thermal overload protection must not interfere with normal circuit operation at temperatures close to the shutdown temperature. Simple thermal shutdown circuits typically have low thermal gain. As a consequence, regulators using these simple shutdown circuits must set shutdown temperature higher than would be desirable.

In view of the foregoing, it would be desirable to be able to provide a voltage reference circuit including a band-gap reference circuit which produces a voltage output having a smaller temperature dependency than that of the band gap reference circuit.

It would further be desirable to be able to provide a voltage reference circuit including a band-gap reference circuit which is also capable of rapidly shutting down surrounding circuitry when the operating temperature exceeds a predetermined threshold value.

In addition, it would be desirable to be able to improve the temperature independence of the reference voltage provided by a band-gap reference circuit and to provide thermal shutdown capability without adding greatly to the complexity of the circuit.

SUMMARY OF THE INVENTION

It is therefore an object of the invention to provide a voltage reference circuit which includes a band-gap reference circuit and means for adjusting the temperature coefficient of the reference voltage provided by the band-gap circuit as a function of temperature.

It is a further object of the present invention to provide a voltage reference circuit including a band-gap reference circuit which is also capable of providing biasing for a thermal shutdown circuit.

These and other objects of the present invention are accomplished by a voltage reference circuit in which a breakpoint compensating voltage is generated at temperatures exceeding a predetermined temperature by a breakpoint compensating transistor which is biased by a positive temperature coefficient voltage produced by the band-gap reference. The voltage reference circuit further includes a thermal limit transistor which is biased by a voltage produced by the breakpoint compensating transistor.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
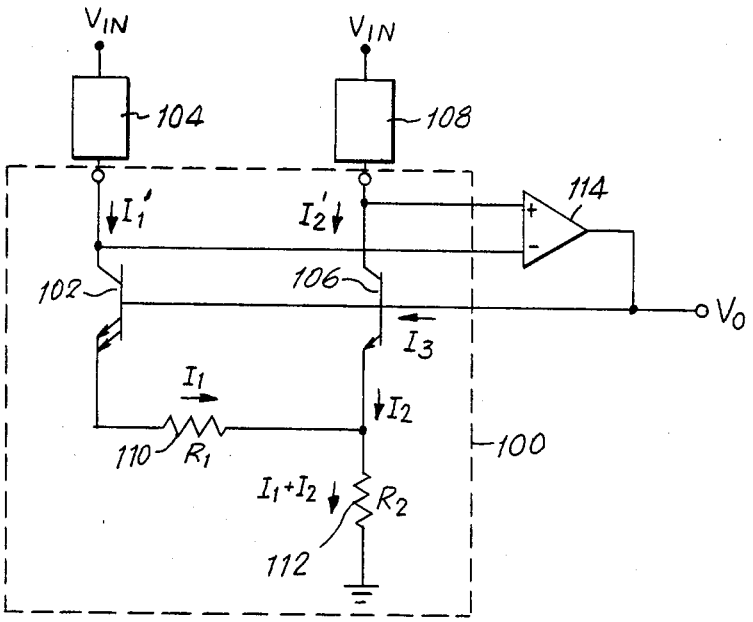
FIG. 1 PRIOR ART
FIG. 1 is a schematic diagram of a conventional Brokaw Cell band-gap reference circuit.

Referring to FIG. 1, a conventional Brokaw Cell band-gap reference circuit 100 is shown. Circuit 100 includes transistor 102, the collector of which is connected to a load 104, and the base of which is connected to the base of transistor 106. Transistor 102 has multiple emitters tied together to provide an emitter area n times that of transistor 106, so that transistors 102 and 106 operate at different current densities. A typical value for n is 10, although other values of n may be used. The emitters of transistor 102 are connected to one end of resistor 110, and the other end of resistor 110 is connected to the emitter of transistor 106 and to one end of resistor 112. The other end of resistor 112 is connected to ground. The collector of transistor 106 is connected to load 108. An amplifier 114 has an output connected to terminal $V_o$, a non-inverting input connected to the collector of transistor 106, and an inverting input connected to the collector of transistor 102.

Loads 104 and 108 can operate as a current mirror, providing substantially equal currents $I_1'$ and $I_2'$ in the collectors of transistors 102 and 106, respectively. They may also be simple resistor loads. In either case, the collector currents do not need to be equal. They can be ratioed to create the effect of emitter-area ratios. Assuming that base current $I_3$ is provided to transistors 104 and 106 to forward bias their respective base-emitter junctions, the difference in emitter area between the emitters of transistors 102 and 106 results in a difference voltage $\Delta V_{BE}$ across resistor 110. Neglecting the effect of base current, current $I_1$ equals current $I_1'$, and current $I_2$ equals current $I_2'$. A current having a value equal to the sum of currents $I_1$ and $I_2$ flows through resistor 112.

The voltage $V_O$ at the base of transistors 102 and 106 is equal to the sum of the base-emitter voltage $V_{BE}$ of transistor 106 and the voltage across resistor 112. The base-emitter voltage $V_{BE}$ of transistor 106 has a negative temperature coefficient of approximately $-2$ mV/°C. The difference voltage $\Delta V_{BE}$ has a positive temperature coefficient because it is a function of the thermal voltage $V_T$, which in turn is proportional to the absolute temperature according to the formula $V_T=kT/q$, where k is Boltzmann's constant q is the electronic charge, and T is the absolute temperature. The circuit operates such that the negative temperature coefficient of the base-emitter junction of transistor 106 opposes the positive temperature coefficient of voltage difference $\Delta V_{BE}$. To a first approximation, the coefficients cancel one another when voltage $V_O$ at the bases of transistors 102 and 106 is approximately 1.2V (the band-gap voltage of silicon), such that at that voltage level the change in voltage $V_O$ with a change in temperature is nominally zero. The circuit thus produces a temperature-stabilized voltage $V_O$ when the values of emitter ratio n and resistors $R_1$ and 112 are chosen to provide a voltage $V_O$ approximately equal to 1.2V.

The principle underlying the theoretical operation of circuit 100 treats the temperature dependence of the base-emitter voltage $V_{BE}$ of transistor 106 and the voltage difference $\Delta V_{BE}$ as linear terms. However, each of the terms actually varies non-linearly with changes in temperature. As a result, circuit 100 exhibits a net temperature coefficient of zero at only one temperature and voltage $V_O$ varies with changes in temperature. The output voltage/temperature curve of a typical Brokaw Cell band-gap reference circuit for a range of temperatures $T_1$–$T_2$ is shown in FIG. 2.

Figure 2:
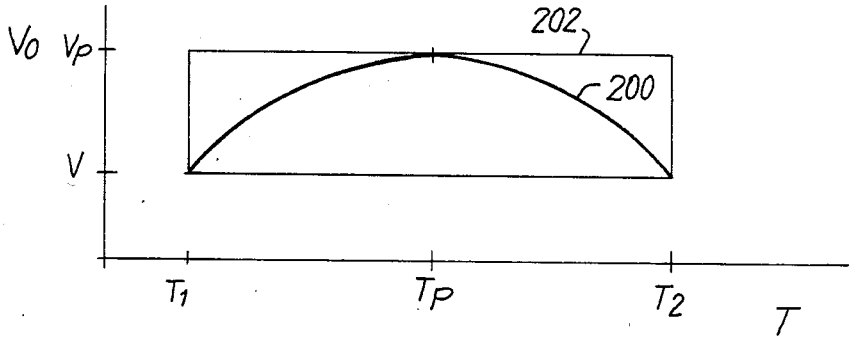
FIG. 2 PRIOR ART
FIG. 2 is a graph showing the output voltage of the Brokaw Cell band-gap reference circuit of FIG. 1 over a range of operating temperatures.

As can be seen from FIG. 2, curve 200 of output voltage $V_O$ reaches a peak voltage $V_P$ at a temperature $T_P$, and degrades as the temperature either increases or decreases from the value $T_P$. At temperature $T_P$, the slope of curve 200 is zero, indicating that the circuit is temperature-stabilized at that point, but stability is lost at an increasing rate as the temperature increases or decreases from temperature $T_P$.

A measure of the average temperature stability of the voltage output of a Brokaw cell over a particular temperature range $T_1$–$T_2$ is established by drawing a rectangle 202 around curve 200, rectangle 202 being just large enough to include the entirety of curve 200. The smaller the area of rectangle 202, the more stable the output of the circuit is over the given range of temperatures.

One approach to reducing the instability of a voltage reference circuit is to provide breakpoint compensation. Breakpoint compensation is accomplished by introducing a correcting influence on the operation of the circuit at a particular temperature (the breakpoint temperature) to change the net temperature coefficient of the circuit, and to thereby change the shape of curve 200 so as to reduce the area of rectangle 202.

Figure 3:
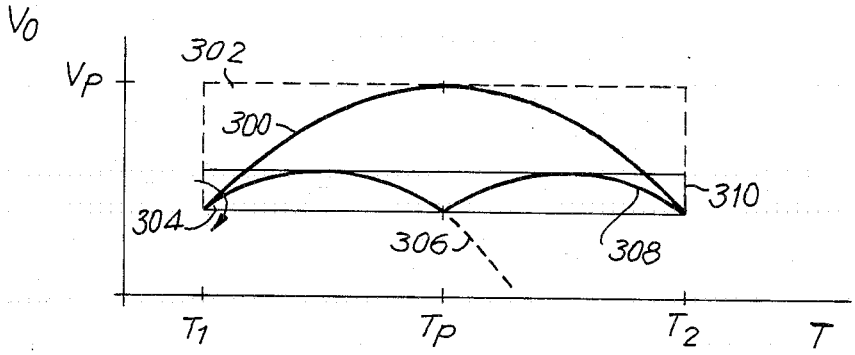
FIG. 3 is a graph showing the output voltage of a voltage reference circuit including a Brokaw Cell and breakpoint compensation means.

FIG. 3 shows how breakpoint compensation affects the output voltage of a typical Brokaw Cell. Curve 300 represents the output voltage of a theoretical Brokaw Cell over a temperature range of $T_1$–$T_2$. The temperature range is such that the output curve 300 has an apex $V_P$ at temperature $T_P$ in the middle of the temperature range. The area of rectangle 302 represents the degree of instability over the temperature range $T_1$–$T_2$. Assuming that curve 300 is rigid, and can be "broken" but not "bent", and that curve 300 can be rotated about point $T_1$, as shown by arrow 304, the area of rectangle 302 can be reduced in theory by a factor of four by: rotating curve 300 downward to the position shown by curve 306; breaking the curve 306 at temperature point $T_P$; and rotating the portion of curve 306 between $T_P$ and $T_2$ upward to the position shown by curve 308. The area of rectangle 310 represents the average temperature instability of curve 308.

The effect of this manipulation is to give the Brokaw Cell a more negative temperature coefficient in the temperature range $T_1$–$T_P$, and to make the temperature coefficient more positive in the temperature range $T_P$–$T_2$. Breakpoint compensation is thus a means of shifting the temperature coefficient of a circuit as a function of temperature.

The present invention provides a simple and novel circuit for improving the temperature stability of a band-gap voltage reference, such as a Brokaw Cell, by breakpoint compensation. Although the invention is discussed below in the context of a Brokaw Cell, it will be appreciated that other bandgap reference circuits may be utilized and the invention is not limited to use with a Brokaw Cell. For instance, the invention may be utilized with a bandgap reference which generates a voltage difference having a positive temperature coefficient between the bases of two transistors, rather than between the emitters of two transistors as in a Brokaw Cell. Such other band-gap references are well known, and are not further described herein.

Figure 4:
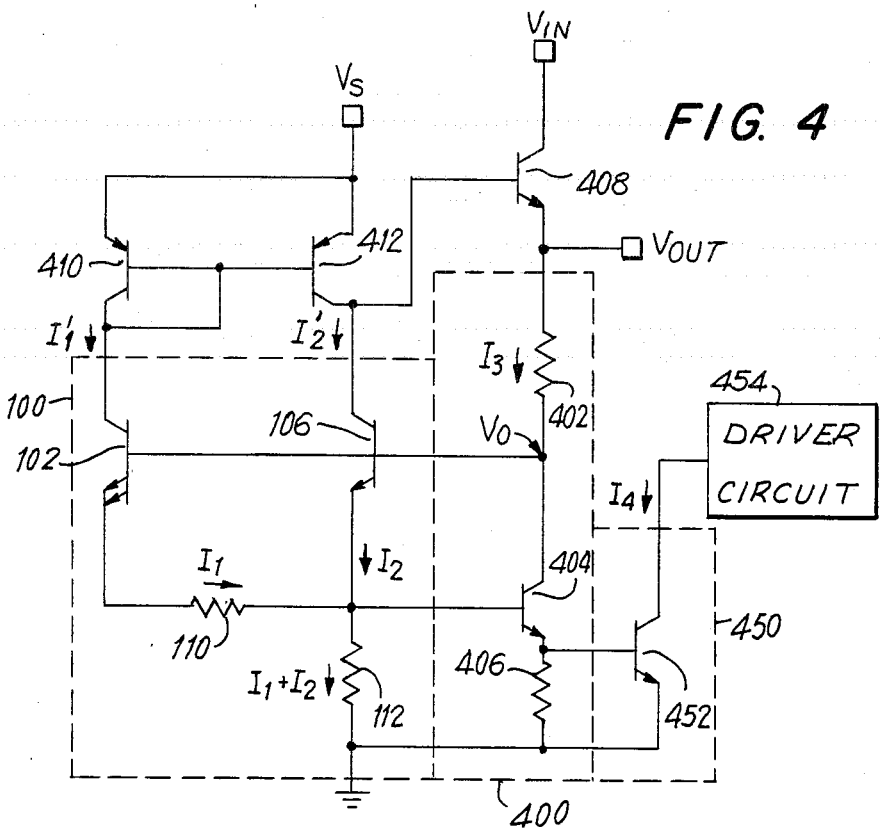
FIG. 4 is a schematic diagram of an embodiment of the voltage reference circuit of the present invention including breakpoint compensation and thermal.

Referring now to FIG. 4, an embodiment of the voltage reference circuit of the present invention is shown for use by an integrated circuit voltage regulator. Brokaw Cell 100 includes transistors 102 and 106 and resistors 110 and 112 connected in the same manner as described for FIG. 1. Emitter ratio n is chosen to be ten, so that the total emitter area of transmitter 102 is ten times greater than the emitter area of transistor 106, although other values of n may be chosen. It is preferable that n be made as large as possible, given size constraints imposed by the integrated circuit in which the invention is used, to reduce the effect of noise on the operation of the circuit.

The values of resistors 110 and 112 determine the temperature coefficient of Brokaw Cell 100 at temperatures below the breakpoint temperature, and are preferably chosen to produce a reference voltage $V_O$ at the base of transistors 102 and 106 having temperature characteristics like the portion of curve 306 in FIG. 3 between temperatures $T_1$ and $T_P$. Reference voltage $V_O$ preferably will have a value of approximately 1.2V when this condition is met. For this purpose, the value of resistor 110 is chosen such that current $I_1$ produces a voltage drop of approximately 60 mV across resistor 110, and the value of resistor 112 is chosen such that the sum of current $I_1$ and current $I_2$ produces a voltage drop of 600 mV across resistor 112 at room temperature (25° C.). Given an emitter ratio n of 10, resistors 110 and 112 have respective values of 1.0 kilohms and 5.0 kilohms in FIG. 4.

Breakpoint compensation circuit 400 includes resistor 402, transistor 404 and resistor 406. The bases of transistors 102 and 106 are connected to one end of resistor 402 and to the collector of transistor 404. The other end of resistor 402 is connected to the emitter of transistor 408 whose collector is connected to a supply voltage and whose base is connected to the collectors of transistors 106 and 412. The base of transistor 404 is connected between resistors $R_1$ and $R_2$, and the emitter of transistor 404 is connected to one end of resistor 406. The other end of resistor 406 is connected to ground.

During operation, current ratio is determined in the Brokaw Cell 100 by transistors 410 and 412, which are connected as a conventional current mirror source between voltage source $V_s$ and the collectors of transistors 102 and 106. Transistors 410 and 412 operate at currents $I_1'$ and $I_2'$ having substantially equal values. Neglecting the effect of base current, currents $I_1'$ and $I_2'$ are substantially equal to currents $I_1$ and $I_2$. The base-emitter voltage of transistor 106 is approximately 600 mV, such that the voltage at the base of transistors 102 and 106 is approximately 1.2V. Due to the positive temperature coefficient of voltage difference $\Delta V_{BE}$ between transistors 102 and 106, the voltage at the junction of resistors 110 and 112 increases at an approximate rate of 2 mV/°C. Concurrently, the base-emitter emitter voltage $V_{BE}$ of transistor 106 has a negative temperature coefficient of approximately −2 mV/°C.; however, the two coefficients vary with changes in temperature such that reference voltage $V_O$ at the base of transistors 102 and 106 varies with changes in temperature. For example, for a temperature range of −55° C. to +150° C., the voltage will vary with temperature approximately as shown by curve 306 of FIG. 3. As can be seen in FIG. 3, reference voltage $V_o$ thus has a temperature coefficient (shown by the slope of curve 306) which decreases as temperature rises and which is negative over most of the temperature range.

Figure 5:
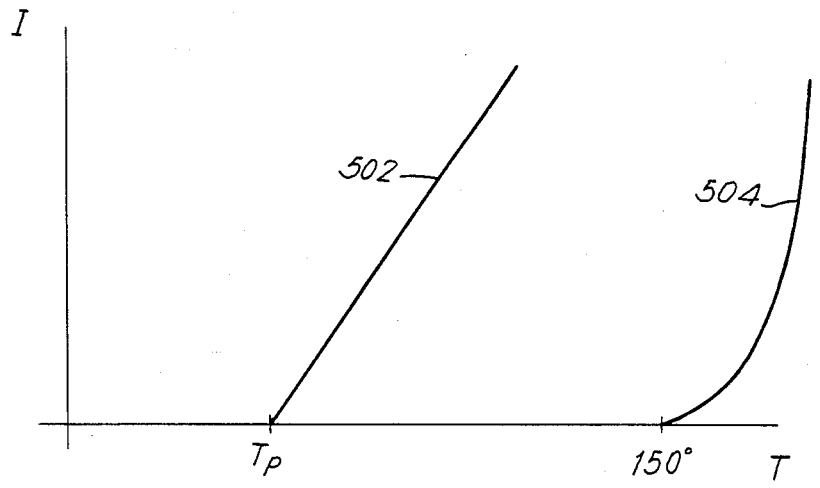
FIG. 5 is a graph showing the operation of the breakpoint compensation and thermal shutdown means of FIG. 4.

To compensate for the negative temperature coefficient of curve 306, resistors 402 and 406 are included to increase temperature coefficient when the voltage at the base of transistor 404, which increases with increasing temperature, reaches a level corresponding to a predetermined breakpoint temperature $T_p$, preferably 25° C. For temperatures below the breakpoint temperature, current $I_3$ through resistor 402 is close to zero, and output voltage $V_{OUT}$ is substantially equal to reference voltage $V_o$ at the base of transistors 102 and 106. When the temperature rises to the breakpoint temperature, the voltage at the base of transistor 404 is sufficiently high to turn the transistor on, and a voltage drop appears across resistor 402 such that the output voltage $V_{OUT}$ becomes greater than reference voltage $V_o$ at the base of transistors 102 and 106. The variation in current $I_3$ with temperature is shown by line 502 in FIG. 5. The rate at which output voltage $V_{OUT}$ increases as compared to the voltage at the base of transistors 102 and 106 with increase in temperature is determined by the temperature coefficient of the emitter voltage of transistor 404 and the ratio of the value of resistor 402 to the value of resistor 406. For temperatures below the breakpoint temperature, the voltage at the base of transistor 404 is insufficient to turn on the transistor, such that no current flows through resistor 406 and the emitter of transistor 404 has a voltage of zero. The temperature coefficient of the emitter voltage of transistor 404 is approximately 4 mV/°C. for temperatures at or exceeding the breakpoint temperature. This coefficient results from the 2 mV/°C. temperature coefficient of the voltage applied to the base of transistor 404 and the −2 mV/°C. temperature coefficient of the base-emitter voltage of transistor 404. A preferable value for the resistor ratio is approximately 0.025. As an example, to establish a breakpoint at 25° C., and to provide breakpoint compensation having a positive temperature coefficient of approximately 0.1 mV/°C., it is preferable that resistor 402 have a value of approximately 200 ohms and resistor 406 have a value of approximately 7.9 kilohms.

It is to be understood that the resistor values chosen are exemplary, and can be varied to set a breakpoint other than 25° C. and a compensation coefficient other than 0.1 mV/°C. The values of breakpoint temperature and compensation coefficient have been chosen to produce a voltage/temperature curve having optimized temperature stability over a range of temperatures from −55° C. to +150° C.

The present invention further includes, with little added complexity, a thermal shutdown circuit which utilizes the temperature coefficient of the breakpoint compensation circuit to provide an accurate response to thermal overload. Referring to FIG. 4, thermal shutdown circuit 450 includes transistor 452 the base of which is connected to the emitter of transistor 404, the emitter of which is connected to ground and the collector of which is connected to driver circuit 454 of the voltage regulator.

As discussed above, the emitter voltage of transistor 404 is approximately zero at temperatures below the breakpoint temperature, and has a positive temperature coefficient of approximately 4 mV/°C. starting at the breakpoint temperature. The emitter voltage of transistor 404 biases the base-emitter junction of transistor 452. Therefore, the voltage applied to the base of transistor 452 increases at a rate of 4 mV/°C. from approximately zero at 25° C. The base-emitter voltage of transistor 452 has a temperature coefficient of −2 mV/°C., such that the base-emitter voltage necessary to turn on transistor 452 decreases at a rate of −2 mV/°C. As a result of these coefficients, an effective thermal drive signal of 6 mV/°C. is applied to the base of transistor 452. The thermal drive signal causes transistor 452 to turn on at a temperature which is preferably chosen to slightly exceed the maximum temperature rating of the voltage regulator. In the circuit of FIG. 4, transistor 452 is preferably caused to turn on at a temperature of approximately 150° C., pulling current $I_4$ out of driver circuit 454. In response, conventional current sensing circuitry in driver circuit 454 limits the power output of the voltage regulator as a function of the magnitude of current $I_4$. As can be seen from FIG. 5, current $I_4$, which is represented by curve 504, increases rapidly as the temperature increases above 150° C. This rapid increase permits the thermal shutdown circuit to respond to over temperature conditions only slightly above the maximum desired operating temperature, thereby shutting the drive circuit 454 down rapidly to prevent any damage which might result from sustained operation at temperatures exceeding the rated value of the regulator. The rapid turn on of transistor 452 with increase in temperature above 150° C. results from the 4 mV/°C. coefficient of the voltage applied at the base of transistor 452 and the −2 mV/°C. coefficient of the base-emitter voltage of transistor 452, which together produce an effective thermal drive signal of 6 mV/°C. to transistor 452.

Thus a novel voltage reference circuit including a band-gap voltage reference, a breakpoint compensation circuit and a thermal shutdown circuit is provided. One skilled in the art will appreciate that the present invention can be practiced by other than the described embodiments, which are presented for purposes of illustration and not of limitation, and the present invention is limited only by the claims which follow.

What is claimed is:

1. In a voltage reference circuit having an output terminal for providing an output voltage at an operating temperature within a range of operating temperatures, first and second supply terminals and a band gap voltage reference providing at a first node a reference voltage which varies in accordance with a temperature coefficient, and at a second node a voltage which is proportional to the difference between base-emitter voltages of two transistors and which has a positive temperature coefficient, a breakpoint compensation circuit comprising:

first resistive means connected between the output terminal and the first node;

means connected to the output terminal and the first supply terminal for supplying a current to the output terminal; and compensating means connected to the first node, the second node and the second supply terminal, and responsive to the voltage at the second node, for developing a compensating voltage across said first resistive means when the operating temperature reaches a breakpoint compensation threshold whereby the output voltage is the sum of the reference voltage and the compensating voltage, and exceeds the reference voltage at operating temperatures equal to or greater than the breakpoint threshold temperature.

2. . The circuit of claim 1, wherein:

said compensating means comprises a first transistor and a second resistive means, and wherein the base of said first transistor is connected to the second node, the collector of said first transistor is connected to said first resistive means, and said second resistive means is connected between the emitter of said first transistor and the second supply terminal.

3. The circuit of claim 1, wherein said first resistive means comprises a resistor.

4. The circuit of claim 2, wherein said first and second resistive means comprise resistors.

5. The circuit of claim 1, wherein the poisitive temperature coefficient of the voltage at the second node is equal to or greater than 2 mV/°C.

6. The circuit of claim 1, wherein said compensating means produces at a third node a voltage having a positive temperature coefficient greater than that of the voltage at the secod node, and wherein the circuit further comprises:

thermal shutdown means connected to the third node and responsive to the voltage at the third node for providing a thermal shutdown signal when the operating temperature exceeds a thermal shutdown temperature threshold.

7. The circuit of claim 6, wherein:

said thermal shutdown means comprises a second transistor having a base-emitter junction which is biased by the voltage at the third node, and wherein the thermal shutdown signal appears at said second transistor's collector.

8. The circuit of claim 7, wherein the voltage biasing the base-emitter junction of said second transistor has an effective positive temperature coefficient equal to or greater than 6 mV/°C.

9. In a voltage reference circuit having an output terminal for providing an output voltage at an operating temperature within a range of operating temperatures, first and second supply terminals and a band gap voltage reference providing at a first node a reference voltage which varies in accordance with a temperature coefficient, and at a second node a voltage which is proportional to the difference between base-emitter voltages of two transistors and which has a positive temperature coefficient, a breakpoint compensation circuit comprising:

a first resistor connected between the output terminal and the first node;

means connected to the first supply terminal and the output terminal for supplying a current to the output terminal;

a transistor; and a second resistor connected at one end to the second supply terminal; wherein:

said transistor has a base connected to the second node, a collector connected to the first node and an emitter connected to another end of said second resistor to define a third node, said transistor functioning to provide breakpoint temperature compensation by producing a compensating voltage drop across said first resistor when the operating temperature reaches a breakpoint threshold temperature, such that the output voltage is the sum of the reference voltage and the compensating voltage and exceeds the reference voltage at temperatures equal to or greater than the breakpoint threshold temperature.

10. The circuit of claim 9, further comprising:

a second transistor to provide a thermal shutdown signal, said second transistor having a base-emitter circuit which is biased by a voltage at the third node having an effective positive temperature coefficient equal to or greater than 6 mV/°C.

11. In a circuit having an output terminal for providing an output voltage at an operating temperature within a range of operating temperatures and a band gap voltage reference providing at a first node a first voltage which has a temperature coefficient, and at a second node a second voltage which is proportional to the difference between base-emitter voltages of two transistors and which has a positive temperature coefficient, a breakpoint compensation circuit comprising:

means for supplying a current to the output terminal; and means connected to the output terminal and to the first node, and responsive to the second voltage at the second node, for developing a compensating voltage between the output terminal and the first node when the operating temperature reaches a breakpoint compensation threshold, whereby the output voltage is comprised of at least the sum of the first and compensating voltages, and exceeds the first voltage at operating temperatures which exceed the breakpoint threshold temperature.

12. The circuit of claim 11, wherein said compensating voltage developing means includes:

a resistive means connected between the output terminal and the first node; and a transistor connected to the first node and to the second node, whereby said transistor causes the compensating voltage to be developed across said resistive means when the operating temperature exceeds the breakpoint threshold temperature.

13. The circuit of claim 12, wherein the compensating voltage increases with increasing operating temperature.

14. The circuit of claim 11 wherein said compensating voltage developing means produces at a third node a third voltage having a positive temperature coefficient greater than that of the second voltage, and wherein the circuit further comprises:

means responsive to the third voltage at the third node for producing a thermal shutdown signal when the operating temperature exceeds a thermal shutdown temperature threshold.

15. The circuit of claim 14, wherein said thermal shutown signal means consists of a second transistor having a base-emitter junction which is biased by the third voltage at the third node.

16. The circuit of claim 15, whererin the voltage biasing the base-emitter junction of said second transistor has an effective positive temperature coefficient greater than 5 mV/°C.

17. The circuit of claim 16, wherein the effective positive temperature coefficient of the voltage biasing the base-emitter junction of said second transistor is equal to or greater than 6 mV/°C.

18. In a circuit having an output terminal for providing an output voltage at an operating temperature within a range of operating tempertures and a band gap voltage reference providing at a first node a first voltage which has a temperature coefficient, and at a second node a second voltage which is proportional to the difference between base-emitter voltages of two transistors and which has a positive temperature coefficient, a thermal shutdown circuit comprising:

means responsive to the second voltage at the second node for producing at a third node a third voltage having a positive temperature coefficient greater than that of the second voltage; and means responsive to the voltage at the third node for producing a thermal shutdown signal having an effective positive temperature coefficient equal to or greater than 6 mV/°C.

19. The circuit of claim 18, wherein said thermal shutdown signal producing means produces the thermal shutdown signal when the operating temperature exceeds a thermal shutdown temperature threshold.

20. The circuit of claim 19, wherein said means for producing the third voltage at the third node comprises a transistor having a base-emitter junction which is biased by the second voltage at the second node.

21. The circuit of claim 20, wherein said thermal shutdown signal producing means comprises a second transistor having a base-emitter circuit which is biased by the third voltage at the third node, whereby said second transistor is biased by a voltage having an effective positive temperature coefficient equal to or greater than 6 mV/°C., and wherein the thermal shutdown signal appears at a collector of said second transistor.

22. In a circuit having an output terminal for producing an output voltage at an operating temperature within a range of operating temperatures and a supply terminal and a band gap voltage reference providing at a first node a first voltage which has a temperature coefficient, and at a second node a second voltage which is proportional to the difference between base-emitter voltages of two transistors and which has a positive temperature coefficient, a thermal shutdown circuit comprising:

a resistor connected at one end to the supply terminal;

a transistor having a base connected to the second node, a collector connected to the first node and an emitter connected to another end of said resistor to define a third node; and a second transistor having a base connected to the third node and an emitter connected to the supply terminal, whereby said second transistor is biased by a voltage having an effective positive temperature coefficient equal to or greater than 6 mV/°C.

* * * * *

UNITED STATES PATENT AND TRADEMARK OFFICE

CERTIFICATE OF CORRECTION

PATENT NO. : 4,789,819

DATED : December 6, 1988

INVENTOR(S) : Carl T. Nelson

It is certified that error appears in the above-identified patent and that said Letters Patent is hereby corrected as shown below:

Column 2, line 65, after "thermal" insert -- shutdown means --;

Column 5, line 53, delete "emitter" (second occurrence).

Signed and Sealed this

Seventeenth Day of March, 1992

*Attest:*

HARRY F. MANBECK, JR.

*Attesting Officer*

*Commissioner of Patents and Trademarks*